US006795091B2

(12) United States Patent
Kim

(10) Patent No.: US 6,795,091 B2
(45) Date of Patent: Sep. 21, 2004

(54) DISPLAY APPARATUS AND METHOD FOR GAMMA CORRECTING A VIDEO SIGNAL THEREIN

(75) Inventor: Seong-Bo Kim, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 197 days.

(21) Appl. No.: 09/995,752

(22) Filed: Nov. 29, 2001

(65) Prior Publication Data

US 2002/0118185 A1 Aug. 29, 2002

(30) Foreign Application Priority Data

Feb. 28, 2001 (KR) ..... 2001-10528

(51) Int. Cl.[7] ..... G09G 5/10
(52) U.S. Cl. ..... 345/690; 345/589; 348/674
(58) Field of Search ..... 345/593, 589, 345/590, 600, 601, 605, 690; 348/254, 674

(56) References Cited

U.S. PATENT DOCUMENTS 5,303,071 A * 4/1994 Kakimura ..... 358/519
5,408,267 A 4/1995 Main
5,479,204 A * 12/1995 Iwamatsu ..... 348/96
5,642,161 A * 6/1997 Jefferson ..... 348/186
5,710,594 A * 1/1998 Kim ..... 348/254
5,754,924 A * 5/1998 Yamada ..... 399/81
6,020,921 A 2/2000 Aleksic et al.
6,181,368 B1 * 1/2001 Takahashi et al. ..... 348/65
6,441,870 B1 * 8/2002 Rapaich ..... 348/674
6,573,934 B1 * 6/2003 Lee ..... 348/254

FOREIGN PATENT DOCUMENTS

| | | |
|---|---|---|
| JP | 7-154757 | 6/1995 |
| JP | 7-307898 | 11/1995 |
| JP | 8-223450 | 8/1996 |
| JP | 10-276348 | 10/1998 |
| JP | 11-196293 | 7/1999 |
| KR | 007743/1993 | 4/1993 |
| KR | 019373/1997 | 4/1997 |
| KR | 021285/1998 | 6/1998 |

* cited by examiner

*Primary Examiner*—Xiao Wu
(74) *Attorney, Agent, or Firm*—Robert E. Bushnell, Esq.

(57) ABSTRACT

A display apparatus comprising a gamma correction part for gamma correcting an input video signal; a selection input part for selecting the amount of correction by the gamma correction part; and a micro-control unit for controlling the correction amount by the gamma correction part depending upon a selection from the selection input part. With this configuration, the input video signals are gamma corrected within the display apparatus and can be output in the optimal state. And, whether to perform gamma correction or not, and the amount of gamma correction for the display apparatus may be selected as the user desires.

19 Claims, 6 Drawing Sheets

AMPLIFIED VIDEO SIGNAL

VIDEO SIGNAL CONVERTED INTO THE FORM OF EXPONENTIAL FUNCTION

VIDEO SIGNAL AFTER GAMMA-CORRECTION

DISPLAY APPARATUS AND METHOD FOR GAMMA CORRECTING A VIDEO SIGNAL THEREIN

CLAIM OF PRIORITY

This application makes reference to, incorporates the same herein, and claims all benefits accruing under 35 U.S.C §119 from an application entitled Display Device earlier filed in the Korean Industrial Property Office on 28, Feb. 2001, and there duly assigned Serial No. 01-10528 by that Office.

BACKGROUND OF THE INVENTION

1. Field of the Invention

The present invention relates in general to a display apparatus, and more particularly, to a display apparatus having a function of gamma correcting a video input signal so as to allow a video output signal to have an ideal brightness.

2. Description of the Related Art

Conventionally, a display apparatus receives a video synchronizing signal and an RGB video signals applied from a video card, amplifies the RGB video signals through a pre-amplifier and a main amplifier and displays the amplified signals on the screen of the display apparatus. The brightness comparative to an input voltage level is to be output on the display apparatus.

FIG. 4 shows a brightness graph illustrating changes of the brightness vs. the input voltage level, having a horizontal axis for the video signal applied from a video signal source such as a computer, etc. and a vertical axis for the brightness output in the display apparatus. Referring to FIG. 4, it is desirable that an output of the display apparatus has a brightness curve 51*b* straight in proportion to a voltage level of the video signal input; however, the output for the input voltage level in a certain section, that is, an actual brightness value is much less than the ideal brightness value, as shown by brightness curve 51*a*. Such brightness curve is caused by loss of signals in the course of amplification of the respective R, G and B video signals in the main amplifier, errors of parts of the amplifiers, illumination efficiency of displaying elements, etc.

Thus, the video signal supply source such as a computer, etc. has employed a method of amplifying the video signals in advance with gamma correction and applying the corrected signals to the display apparatus.

However, a rate of attenuation of the video signals are different in the respective display apparatuses in the course of treating the video signals, whereas the computer supplies the video signals gamma corrected in a uniform manner. Thus, an optimal brightness cannot be output due to an inherent attenuation property of a display apparatus although the gamma corrected video signals are input.

In addition, there is a problem in that such display apparatuses for medical machines or book searches are unable to reproduce the brightness of the video signals because their video signal supply sources have no function for gamma correction.

SUMMARY OF THE INVENTION

Accordingly, the present invention has been made keeping in mind the above-described problems, and an object of the present invention is to provide a display apparatus enabling an optimal output of input video signals through gamma correction in the display apparatus itself.

Another object of the present invention is to provide a display apparatus allowing a user to select whether to do the gamma correction or to select an amount of correction in the display apparatus as described by the user.

These and other objects of the present invention may be accomplished by the provision of a display apparatus, comprising a gamma correction part for gamma correcting an input video signal; a selection input part for selecting the amount of correction by the gamma correction part; and a micro-control unit for controlling the correction amount by the gamma correction part depending upon a selection from the selection input part.

Here, the selection input part is comprised of OSD (on-screen display) control buttons for controlling a display screen.

Preferably, the gamma correction part is comprised of a plurality of gamma section parts for receiving the video signals having predetermined upper limits, or less, and gamma correcting the video signals; a mixer for composing the video signals gamma corrected by the gamma section parts.

Desirably, each of the gamma section parts is comprised of a plurality of signal amplifier parts sectioned into a plurality of sections depending upon the voltage levels of the video signals, for receiving the video signals having the predetermined upper limits, or less, corresponding to the respective sections and amplifying them at predetermined rates; a signal converter part converting the video signal amplified in each signal amplifier part into the form of an exponential function, processing the video signal into the form of a reverse function thereafter, and outputting the video signal in the form of a converted hyperbolic tangent function; and a signal adjuster part adjusting a voltage level of the converted video signal according to the control signal from the micro-control unit.

According to another aspect of the present invention, the above and other objects maybe also achieved by the provision of a method for gamma correcting a video signal in a display apparatus, comprising the steps of selecting the amount of gamma correction; gamma correcting the video signal according to the selected correction amount; and displaying the gamma corrected video signal.

Desirably, the gamma correction step is comprised of sectioning the video signals into a plurality of sections depending upon voltage levels of the video signals, receiving the video signal having a predetermined upper limit or less and amplifying it; converting the video signal amplified into the form of an exponential function, processing the video signal into the form of a reverse function thereafter, and outputting the video signal in the form of a converted hyperbolic tangent function; amplifying the converted video signal according to the selected gamma correction amount; and composing the amplified video signal.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENT

The preferred embodiment of the present invention will be described in more detail with reference to the accompanying drawings.

Figure 1:
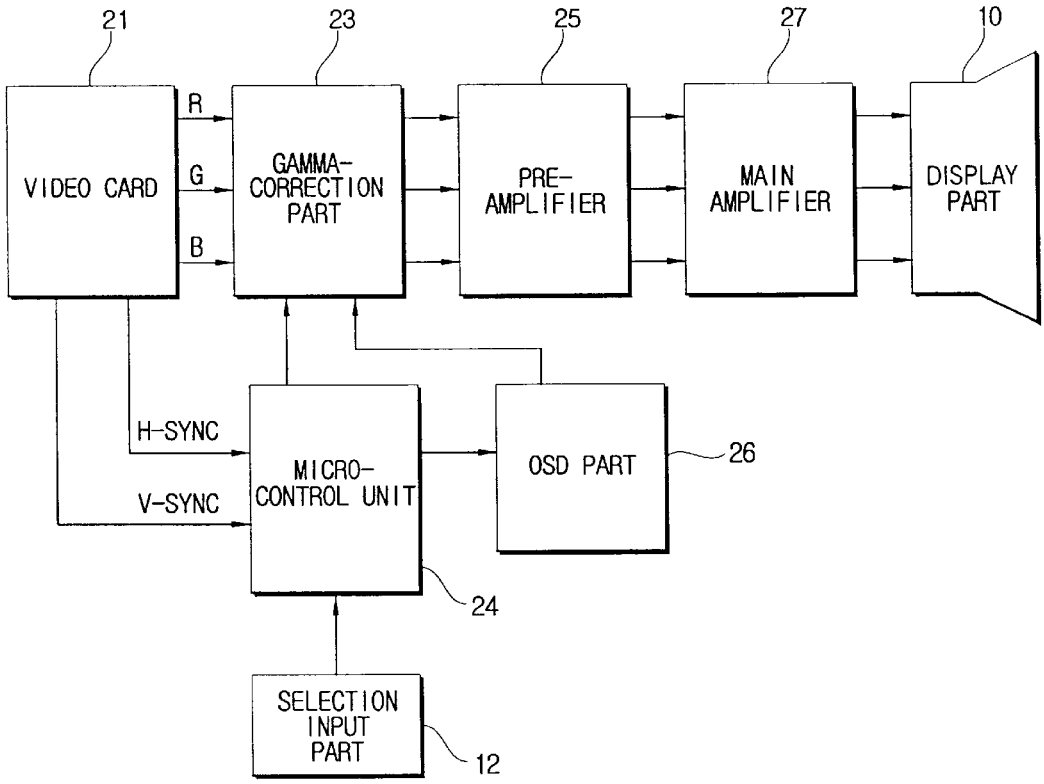
FIG. 1 is a control block diagram of a display apparatus according to the present invention.

Referring to FIG. 1 which is a control block diagram of a display apparatus according to claim 1, the display apparatus is comprised of a gamma correction part 23 for gamma correcting video signals applied from a video card 21, a pre-amplifier 25 and a main amplifier 27 for treating the video signals gamma corrected in the gamma correction part 23, a display part 10 displaying the video signals amplified in the main amplifier 27, a selection input part 12 selecting an amount of gamma correction, an on screen display (OSD) part 26 generating display information about the selection by the selection input part 12, and a micro-control unit 24 applying a control signal to the gamma correction part 23 according to the selection by the selection input part 12.

Figure 2:
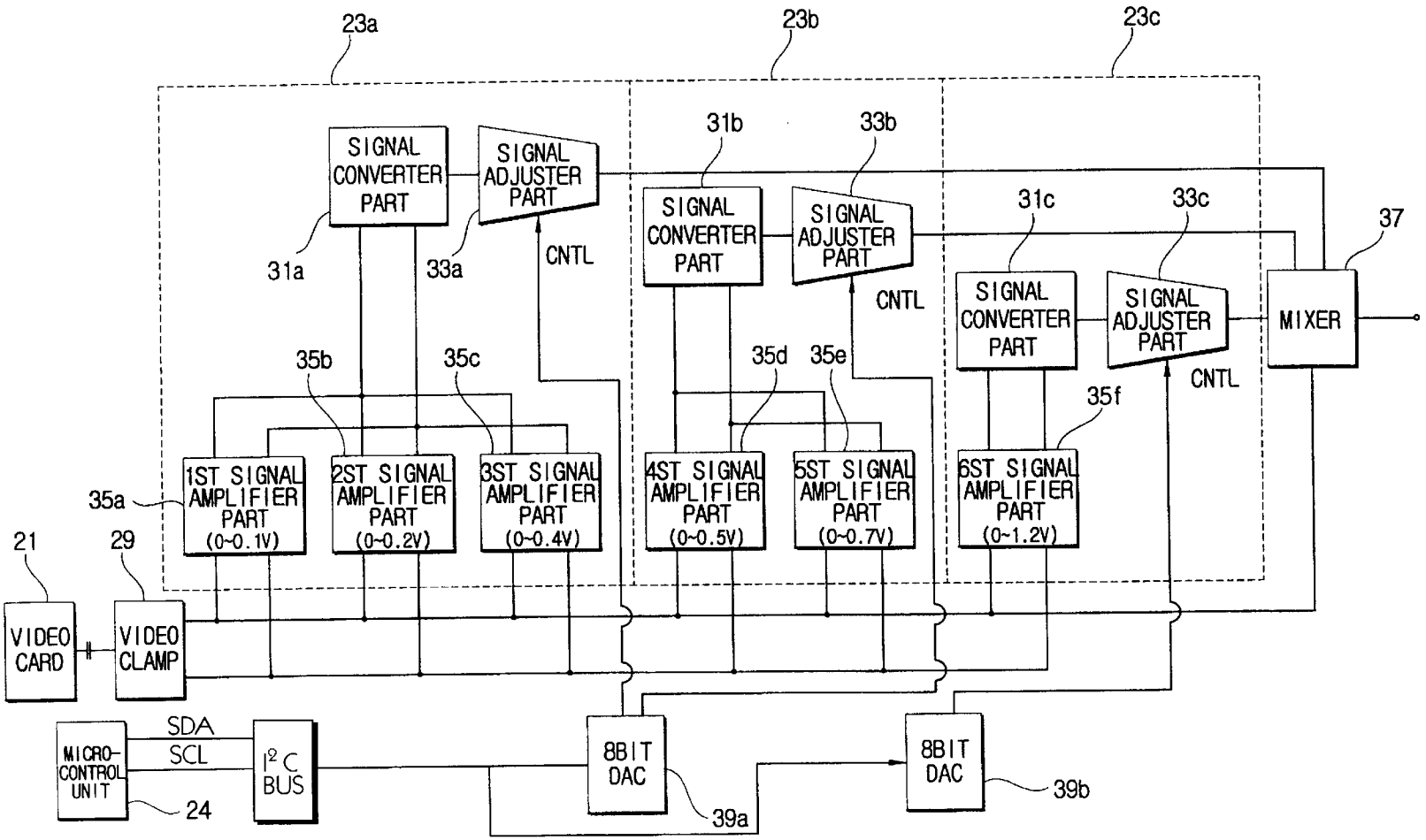
FIG. 2 is a detailed block diagram of a gamma correction part of FIG. 1.

FIG. 2 is a detailed block diagram of the gamma correction part 23 of FIG. 1. As illustrated in this figure, the gamma correction part 23 includes a video clamp 29 correcting a direct current (DC) voltage of the R, G and B input signals applied from the video card 21 in a uniform manner, a plurality of gamma section parts 23*a*, 23*b* and 23*c* converting the video signals having lower values than their upper limit values and outputting the gamma corrected video signals, and a mixer 37 composing the video signals respectively from the gamma section parts 23*a*, 23*b* and 23*c*.

The gamma section parts 23*a*, 23*b* and 23*c* include a plurality of signal amplifier parts 35*a* through 35*f* receiving a video signal and amplifying it to a predetermined rate therein, signal converter parts 31*a*, 31*b* and 31*c* converting the amplified video signals into exponential functions, into inverse functions, and then into hyperbolic tangent functions, and signal adjuster parts 33*a*, 33*b* and 33*c* amplify the gamma corrected video signals by adjusting voltage levels of the gamma corrected video signals, output from the signal converter parts 31*a*, 31*b* and 31*c*. The signal adjuster parts 33*a*, 33*b* and 33*c* receive control signals from micro-control unit (MCU) 24 according to selection of an OSD control button of the selection input part 12, and amplify the gamma corrected video signals by adjusting the voltage level of the gamma corrected video signals. Particularly, the micro-control unit 24 communicates with the gamma correction parts 23*a*–23*b* via communication lines SDA and SCL, I2C bus 22 and two digital-to-analog converters (DAC), 39*a* and 39*b* as discussed below.

Each of the signal amplifier parts 35*a*, 35*b* and 35*c* within the gamma section part 23*a* are preset with an input signal upper limit value limiting the input of the video signals according to their voltage levels, and with an amount for amplification of the input video signals. Thus, the amplified signal is output at a different rate depending upon the voltage level of the video signal in each of the signal amplifier parts 35*a*, 35*b* and 35*c*.

Video clamp 29 functions to adjust the reference level of the video signal inputted into the gamma correction parts 23*a*–23*c* by adjusting the direct current (DC) voltage level, which varies depending on the type of video card 21 being used. Video clamp 29 then outputs the clamped video signal and the DC voltage level. Accordingly, a video signal having a voltage of 0.4V or less is dividedly (the clamped video signal and the DC voltage level) input into the first, second and third signal amplifier parts 35*a*, 35*b* and 35*c* and then amplified, in the first gamma section part 23*a*, a video signal having a voltage of 0.7V or less is dividedly (the clamped video signal and the DC voltage level) input into the fourth and fifth signal amplifier parts 35*d* and 35*e*, in the second gamma section part 23*b*, and a video signal having a voltage of 1.2V or less is dividedly (the clamped video signal and the DC voltage level) input into the sixth signal amplifier part 35*f*, in the third gamma section part 23*c*.

The reason why a plurality of the signal amplifier parts 35*a* through 35*e* are utilized in the gamma section parts 23*a* and 23*b* is to effectively gamma correct a low-voltage video signal having a larger signal attenuation at an output terminal of the display apparatus by amplifying the low-voltage video signal largely in comparison with a high-voltage video signal. That is, the amounts of amplification for the first, second and third signal amplifier parts 35*a*, 35*b* and 35*c* within the gamma section part 23*a* may be preset to have values of three times, two times, and one and a half times, in order to allow the amplification ratios of the signal amplifying parts 35*a* through 35*f* to be different.

The video signals amplified in the signal amplifier parts 35*a* through 35*f* are input into the respective signal converter parts 31*a*, 31*b* and 31*c*, as shown, to then be converted into the video signals in the form of hyperbolic tangent. The converted video signals are input into the respective signal adjuster parts 33*a*, 33*b* and 33*c*. The signal adjuster parts 33*a*, 33*b* and 33*c* are supplied with control signals of MCU 24 according to selection of the amount of gamma correction by the selection input part 12, amplify the converted video signals by adjusting the voltage level of the converted video signals and provide the gamma corrected video signals to the mixer 37.

The MCU 24 supplies the control signals to the respective signal adjuster parts 33*a*, 33*b* and 33*c* within the gamma correction part 23 through the two digital-to-analog converters (DAC), 39*a* and 39*b*, converting digital signals into analog signals. DAC 39*a* controls the two signal adjuster parts 33*a* and 33*b* amplifying gamma corrected video signals of 0V to 0.7V, and DAC 39*b* controls the signal adjuster part 33*c* amplifying gamma corrected video signals of high voltage of 0V to 1.2V, thereby making an output curve of the video signal smooth.

Figure 3A:
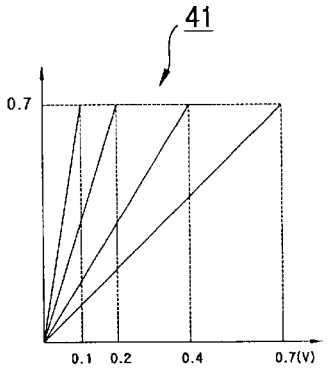
FIGS. 3*a* through 3*c* are graphs showing conversion of video signals within a signal converter part of FIG. 2.
Figure 3B:
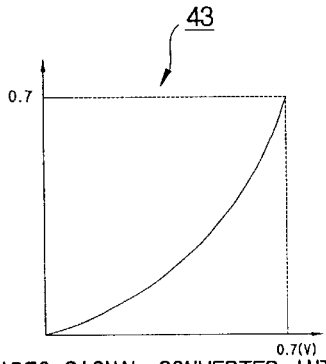
Figure 3C:
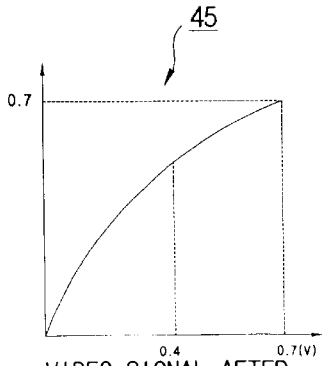

FIGS. 3*a*, 3*b* and 3*c* are graphs showing conversion of the video signals within the signal converter parts 31*a*, 31*b* and 31*c* of FIG. 2. The video signals input into the respective gamma section parts 23*a*, 23*b* and 23*c* are gamma corrected through the processes for signal conversion as in FIGS. 3*a* to 3*c*.

Hereinafter, a gamma correction process of a single gamma section part 23*a* will be described. The first, second and third signal amplifier parts 35*a* through 35*c* amplify the video signals for output, as depicted in FIG. 3*a*. The signal converter part 31*a* of FIG. 2 receives the amplified video signals and converts them into a video signal 43 of an exponential function as shown in FIG. 3*b*. Thereafter, the video signal 43 is processed by a reverse function and then changed to a video signal 45 in the form of hyperbolic tangent function as in FIG. 3*c*.

Figure 4:
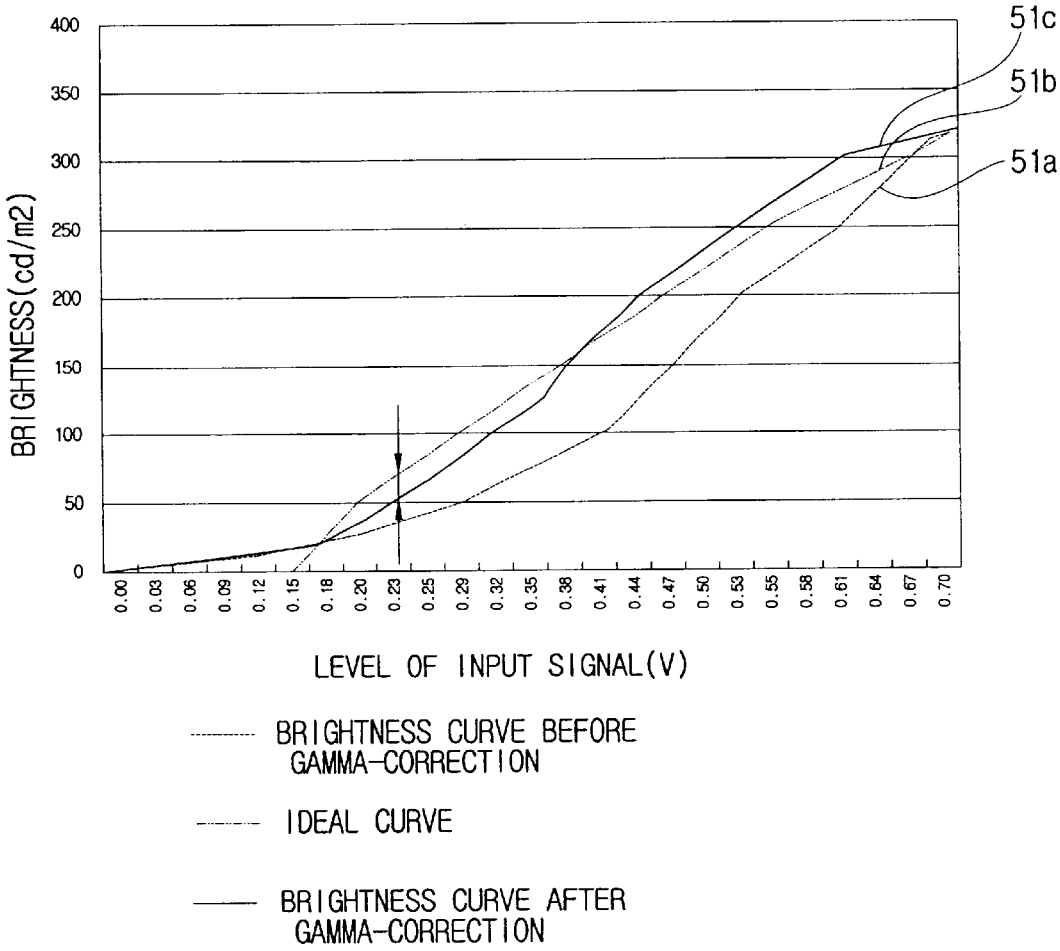
FIG. 4 is a brightness graph for illustrating the display apparatus according to the present invention.

FIG. 4 shows a brightness curve for illustrating the display apparatus according to the present invention. The brightness curve 51*c* according to the gamma corrected video signal in the display apparatus indicates an optimal brightness value even under an input signal of low voltage, approaching an ideal brightness curve 51*b* as seen in this figure.

Figure 5:
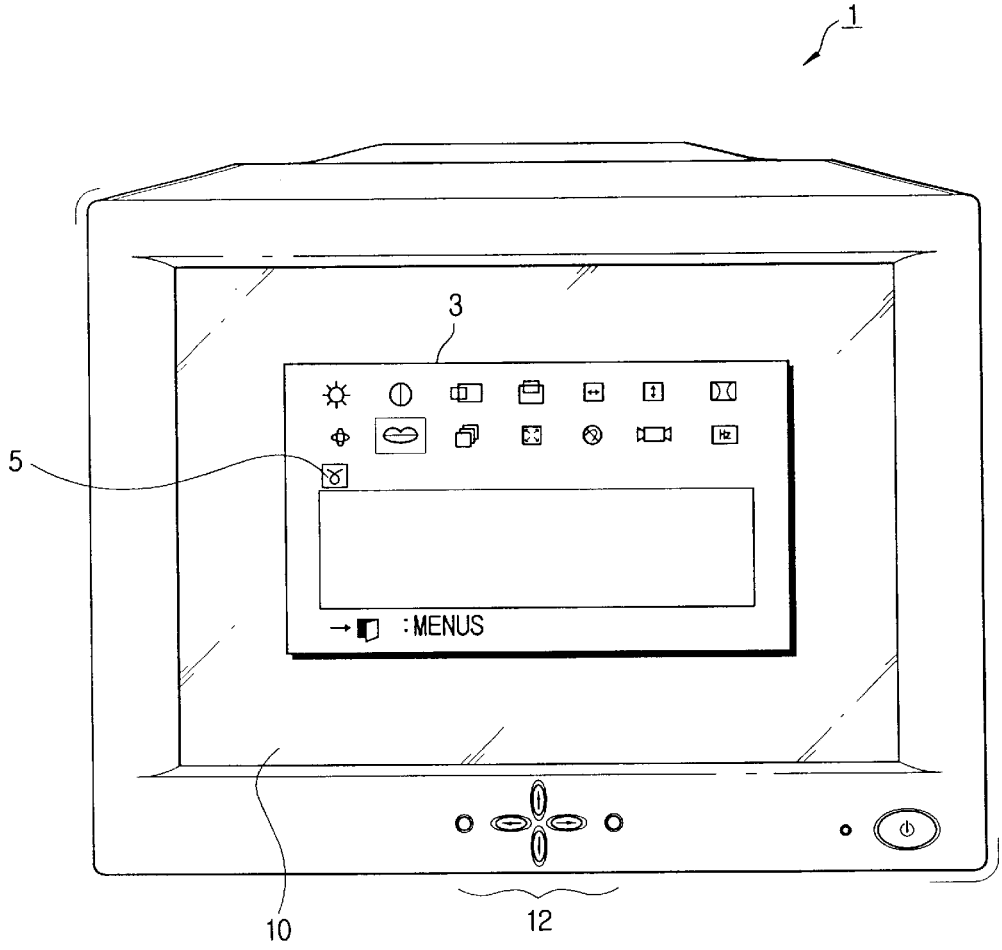
FIG. 5 is a display screen representing OSD menus thereon of the display apparatus according to the present invention.
Figure 6:
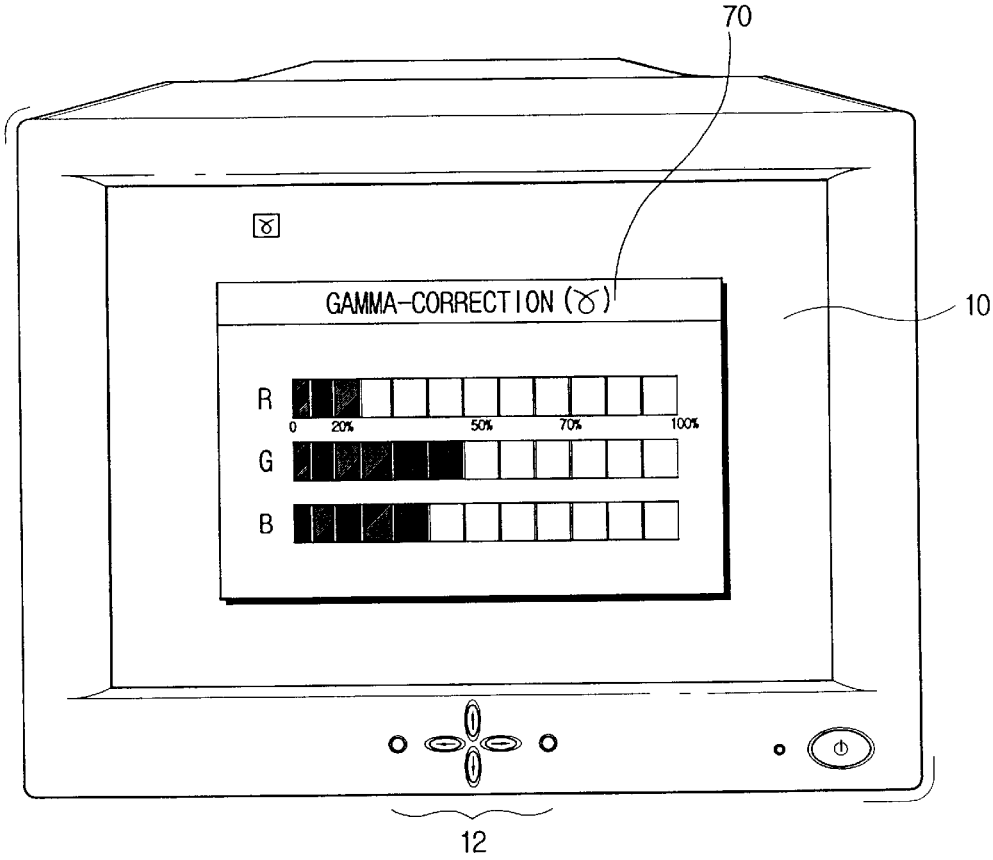
FIG. 6 is a display screen enabling selection of an amount of gamma correction according to the present invention.

FIG. 5 is an OSD menu displaying screen of the display apparatus according to the present invention, and FIG. 6 is an OSD controlling display for selecting an amount for gamma correction in FIG. 5. As shown in FIG. 5, in the lower end of the display apparatus 1 is provided OSD control buttons as a selection input part 12 for setting up the OSD. If an OSD control button is selected, an OSD menu window 3 comprised of a plurality of icons, including a gamma correction icon 5, to adjust the displaying states are displayed, according to the present invention.

If the gamma correction icon 5 in FIG. 5 is selected, a gamma correction window 70 is displayed as depicted in FIG. 6. The gamma correction amounts relative to the respective video signals for R, G and B are displayed in the form of bars in the gamma correction window 70. Selecting R, G or B to be corrected is controlled using the up or down directions keys of the OSD control buttons, and the gamma correction amounts can be increased or decreased according to the selection of left or right direction keys of the OSD control buttons 12.

In the above-described embodiment, voltage levels of the video signals gamma corrected are controlled by means of the OSD control buttons. However, the voltage sizes can be amplified at a rate predetermined by the control signals applied to the respective signal adjuster parts 33*a*, 33*b* and 33*c* of the gamma correction part 23, without the user's selection.

In the above-described embodiment, the amounts for amplification is predetermined by the signal amplifier parts 35*a* through 35*f*. However, the amplification amounts may be adjusted by allowing the micro-control unit 24 to apply a control signal to the signal amplifier parts 35*a* through 35*f*, according to the selection of the OSD control buttons 12.

With this configuration, since the amplification amounts of the video signals applied from the video card are gamma corrected with gamma differently depending upon the voltage levels thereof, a display apparatus having a brightness feature approximate to an ideal brightness curve can be obtained. Also, the user can select as whether to perform gamma correction for the display apparatus and how much to make the gamma correction, at his/her desire.

According to the present invention, whether to perform gamma correction or not, and the amount of gamma correction for the display apparatus may be selected as the user desires. In addition, the input video signals are gamma corrected within the display apparatus, and thus, the video signals can be output in the optimal state.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A display apparatus, comprising:

a gamma correction part for gamma correcting an input video signal;

a selection input part for selecting the amount of correction by the gamma correction part; and a micro-control unit for controlling the correction amount by the gamma correction part depending upon a selection from the selection input part, wherein the gamma correction part is comprised of:

a plurality of gamma section parts for receiving video signals having voltage levels of predetermined upper limits, or less, and gamma correcting the video signals; and a mixer for composing the video signals gamma corrected by the gamma section parts into a video image for display, wherein each of the gamma section parts is comprised of:

one or more signal amplifier parts sectioned into a plurality of sections depending upon the voltage levels of the video signals, for receiving the video signals having the predetermined upper limits, or less, corresponding to the respective sections and amplifying them at predetermined rates;

a signal converter part converting the video signal amplified in each signal amplifier part into the form of an exponential function, processing the video signal into the form of a reverse function thereafter, and outputting the video signal in the form of a converted hyperbolic tangent function; and a signal adjuster part adjusting a voltage level of the converted video signal according to a control signal from the micro-control unit.

2. The display apparatus according to claim 1, wherein the selection input part is comprised of an on screen display control button for controlling a display screen.

3. A method for gamma correcting a video signal in a display apparatus, comprising the steps of:

selecting the amount of gamma correction;

gamma correcting the video signal according to the selected correction amount, wherein the gamma correction step is comprised of:

sectioning the video signals into a plurality of sections depending upon voltage levels of the video signal, receiving the video signal having a predetermined upper limit, or less, and amplifying it;

converting the video signal amplified into the form of an exponential function, processing the video signal into the form of a reverse function thereafter, and outputting the video signal in the form of a converted hyperbolic tangent function;

adjusting a voltage level of the converted video signal according to the selected gamma correction amount; and composing the amplified video signal into a video image for display; and displaying the gamma corrected video signal.

4. The method according to claim 3, wherein the sectioning step is comprised of:

sectioning the video signal into a first section, a second section and a third section, wherein the first section video signal has a voltage level of no more than 0.4 volts, the second section video signal has a voltage level of no more than 0.7 volts, and the third section video signal has a voltage level of no more than 1.2 volts.

5. The method according to claim 4, wherein the converting, adjusting and composing steps are comprised of:

converting the amplified video signal of the first section and adjusting its voltage level to output a first gamma corrected signal;

converting the amplified video signal of the second section and adjusting its voltage level to output a second gamma corrected signal;

converting the amplified video signal of the third section and adjusting its voltage level to output a third gamma corrected signal; and mixing the first, second and third gamma corrected signals into said video image for display.

6. The method according to claim 4, further comprising:

amplifying the first section video signal with a first amplifier part for amplifying a video signal having a voltage level of no more than 0.1 volts, with a second amplifier part for amplifying a video signal having a voltage level of no more than 0.2 volts and a third amplifier part for amplifying a video signal having a voltage level of no more than 0.4 volts;

amplifying the second section video signal with a fourth amplifier part for amplifying a video signal having a voltage level of no more than 0.5 volts and a fifth amplifier part for amplifying a video signal having a voltage level of no more than 0.7 volts; and amplifying with a sixth amplifier part for amplifying a video signal having a voltage level of no more than 1.2 volts.

7. The method according to claim 6, wherein the converting, adjusting and composing steps are comprised of:

converting the video signals amplified by the first, second and third amplifiers into a first gamma corrected signal and adjusting its voltage level;

converting the video signals amplified by the fourth and fifth amplifiers into a second gamma corrected signal and adjusting its voltage level;

converting the video signal amplified by the sixth amplifier into a third gamma corrected signal and adjusting its voltage level; and mixing the first, second and third gamma corrected signals into said video image for display.

8. A display apparatus, comprising:

a plurality of gamma section parts sectioning a video signal into a plurality of sections according to voltage levels of the video signals, receiving the video signals having predetermined upper limits, or less, amplifying each of the video signals, and gamma correcting the amplified video signals; and a mixer for mixing the video signals gamma corrected in the respective gamma section pans into a mixed video signal providing a video image for display.

9. The display apparatus according to claim 8, wherein each of the gamma section parts is comprised of:

at least one signal amplifier part amplifying the video signal at a predetermined rate;

a signal converter part converting the video signal amplified in the signal amplifier part into the form of an exponential function, processing the video signal into the form of a reverse function thereafter, and then outputting the video signal in the form of a converted hyperbolic tangent function; and a signal adjuster part for adjusting a voltage level of the converted video signal.

10. The display apparatus according to claim 8, wherein a first one of said gamma section parts includes a first amplifier part for amplifying a video signal having a voltage level of no more than 0.1 volts, a second amplifier part for amplifying a video signal having a voltage level of no more than 0.2 volts and a third amplifier part for amplifying a video signal having a voltage level of no more than 0.4 volts;

a second one of said gamma section parts includes a fourth amplifier part for amplifying a video signal having a voltage level of no more than 0.5 volts and a fifth amplifier part for amplifying a video signal having a voltage level of no more than 0.7 volts; and a third one of said gamma section parts includes a sixth amplifier part for amplifying a video signal having a voltage level of no more than 1.2 volts.

11. The display apparatus according to claim 9, wherein a first one of said gamma section parts includes a first amplifier part for amplifying a video signal having a voltage level of no more than 0.1 volts, a second amplifier part for amplifying a video signal having a voltage level of no more than 0.2 volts and a third amplifier part for amplifying a video signal having a voltage level of no more than 0.4 volts;

a second one of said gamma section parts includes a fourth amplifier part for amplifying a video signal having a voltage level of no more than 0.5 volts and a fifth amplifier part for amplifying a video signal having a voltage level of no more than 0.7 volts; and a third one of said gamma section parts includes a sixth amplifier part for amplifying a video signal having a voltage level of no more than 1.2 volts.

12. The display apparatus according to claim 10, wherein each of the gamma section parts further includes a signal converter part and a signal adjuster part, wherein:

a first signal converter part converts the video signals amplified by the first, second and third amplifiers into a first gamma corrected signal and a first signal adjuster part adjusts the voltage level of the first gamma corrected signal;

a second signal converter part converts the video signals amplified by the fourth and fifth amplifiers into a second gamma corrected signal and a second signal adjuster part adjusts the voltage level of the second gamma corrected signal; and a third signal converter part converts the video signal amplified by the sixth amplifier into a third gamma corrected signal and a third signal adjuster part adjusts the voltage level of the third gamma corrected signal.

13. The display apparatus according to claim 11, wherein each of the gamma section parts further includes a signal converter part and a signal adjuster part, wherein:

a first signal converter part converts the video signals amplified by the first, second and third amplifiers into a first gamma corrected signal and a first signal adjuster part adjusts the voltage level of the first gamma corrected signal;

a second signal converter part converts the video signals amplified by the fourth and fifth amplifiers into a second gamma corrected signal and a second signal adjuster part adjusts the voltage level of the second gamma corrected signal; and a third signal converter part converts the video signal amplified by the sixth amplifier into a third gamma corrected signal and a third signal adjuster part adjusts the voltage level of the third gamma corrected signal.

14. The display apparatus according to claim 10, further comprising:

a selection input part for selecting, respectively, the amount of correction by each of the gamma section parts; and a micro-control unit for controlling the correction amount by each of the gamma section parts depending upon the selections from the selection input part.

15. The display apparatus according to claim 12, further comprising:

a selection input part for selecting the amount of correction by the first, second and third gamma section parts; and a micro-control unit for controlling the correction amount by the gamma section parts depending upon the selections from the selection input part.

16. The display apparatus according to claim 13, further comprising:

a selection input part for selecting the amount of correction by the first, second and third gamma section parts; and a micro-control unit for controlling the correction amount by the gamma section parts depending upon the selections from the selection input part.

17. The display apparatus according to claim 14, wherein the selection input part is comprised of an on screen display control button for controlling a display screen to display a menu comprising a plurality of icons including a gamma correction icon, said gamma correction icon being user selectable for enabling the user to adjust the gamma of red, green and blue video signals.

18. The display apparatus according to claim 12, further comprising:

a selection input part for selecting correction amounts of each of the first, second and third signal adjuster parts; and a micro-control unit for controlling adjustment of the voltage levels of the first, second and third gamma corrected signals by the first, second and third signal adjuster parts depending upon each of the selections from the selection input part.

19. The display apparatus according to claim 13, further comprising:

a selection input part for selecting correction amounts of each of the first, second and third signal adjuster parts; and a micro-control unit for controlling adjustment of the voltage levels of the first, second and third gamma corrected signals by the first, second and third signal adjuster parts depending upon each of the selections from the selection input part.

* * * * *